US009004083B2

(12) United States Patent
Bühlmeyer et al.

(10) Patent No.: US 9,004,083 B2
(45) Date of Patent: Apr. 14, 2015

(54) DISHWASHER, ESPECIALLY DOMESTIC DISHWASHER

(75) Inventors: Alexander Bühlmeyer, Bopfingen (DE); Egbert Classen, Stahnsdorf (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1468 days.

(21) Appl. No.: 12/701,643

(22) Filed: Feb. 8, 2010

(65) Prior Publication Data

US 2010/0200028 A1 Aug. 12, 2010

(30) Foreign Application Priority Data

Feb. 10, 2009 (DE) ..... 10 2009 000 748

(51) Int. Cl.
*A47L 15/50* (2006.01)

(52) U.S. Cl.
CPC ..... *A47L 15/502* (2013.01); *A47L 15/503* (2013.01)

(58) Field of Classification Search
CPC ..... A47L 15/402; A47L 15/502
See application file for complete search history.

(56) References Cited

U.S. PATENT DOCUMENTS

| | | | | |
|---|---|---|---|---|
| 2005/0028847 | A1 | 2/2005 | Kaczmarek | |
| 2007/0119801 | A1 * | 5/2007 | Miele et al. | 211/70.7 |

FOREIGN PATENT DOCUMENTS

| | | | | |
|---|---|---|---|---|
| DE | 4227585 | A1 * | 2/1994 | A47L 15/50 |
| DE | 19624888 | A1 | 7/1997 | |
| DE | 29603397 | U1 * | 7/1997 | A47L 19/04 |
| DE | 102004035725 | A1 | 3/2006 | |
| EP | 107221 | A1 * | 1/2001 | A47L 15/50 |
| GB | 2198032 | A * | 6/1988 | A47L 15/42 |
| JP | S5082558 | U | 7/1975 | |
| JP | 2006280575 | A | 10/2006 | |
| JP | 2007130122 | A | 5/2007 | |
| WO | WO2008077761 | A1 | 7/2008 | |

OTHER PUBLICATIONS

National Search Report EP 10 15 1154 dated Nov. 28, 2014.

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A dishwasher including a cutlery basket that has an adjustable compartment. The adjustable compartment receives a cutlery item that is adjustable between a loading position for loading and/or unloading the adjustable compartment and an angled position for carrying out cleaning and/or drying the cutlery item. In the angled position, a first clearance height of the cutlery item is reduced in relation to a second clearance height of the cutlery item in the loading position.

21 Claims, 4 Drawing Sheets

DISHWASHER, ESPECIALLY DOMESTIC DISHWASHER

BACKGROUND OF THE INVENTION

The invention relates to a dishwasher and to a cutlery basket.

The washing compartment of a dishwasher is divided up by means of an upper and a lower crockery basket so that larger crockery items such as plates or pots can be stacked in the lower crockery basket. Because of its reduced height, the upper crockery basket on the other hand tends to have smaller crockery items such as glasses or cups put into it.

In a generic dishwasher, a cutlery basket, into which cutlery items can be placed, is generally arranged in the lower crockery basket. For easy loading of the cutlery basket, the cutlery items can be inserted in a vertically-aligned loading position. Thus, the clearance height of the cutlery items corresponds approximately to the length of the cutlery items. By arranging the cutlery basket in the lower crockery basket, the stacking space for the plates or pots in the lower crockery basket is reduced.

BRIEF SUMMARY OF THE INVENTION

It is an object of the invention to provide a cutlery basket for a dishwasher for which the required space in the loaded state can be reduced despite its large loading capacity.

The invention is based on a dishwasher, especially a domestic dishwasher, at least featuring one cutlery basket, especially a cutlery basket that can be inserted into a crockery basket, which has at least one adjustment compartment for accepting a least one cutlery item that can be adjusted between a loading position for loading and/or unloading the adjustable compartment and an angled position for carrying out cleaning and/or drying of the cutlery item. Inventively, the clearance height of a cutlery item is reduced in the angled position as compared to the clearance height of a cutlery item in the loading position.

In the loading position, at least one cutlery item can be inserted essentially vertically. The least one adjustable compartment can be moved from the loading position into the angled position and/or vice versa by a hinging movement.

Preferably, the dishwasher can have a plurality of adjustable compartments for accepting cutlery items. The adjustable compartments can be hingeable on axes running in parallel to one another. In a further embodiment, the adjustable compartments can be hingeable around one axis.

In the angled position, as a result of the reduced clearance height of the cutlery items, the cutlery basket can also be built into the upper crockery basket, whereby additional stacking room can be gained in the lower crockery basket. The inclination of the cutlery items mean that these are more exposed to the spray jet from the spray arm as well as to the water falling downwards than with conventional vertical positioning. This improves the mechanical removal power in the washing process. In this way, an improved cleaning power can be provided.

The crockery basket can have adjustable compartments separated from one another by partitions, into which cutlery items can be inserted. Simple loading of the cutlery basket is made possible by inserting the cutlery items vertically. To this end, the partitions separating the adjustable compartments can project vertically upwards in the loading position.

In a simple embodiment, the adjustment device can be a least one of these partitions which can move the stacked cutlery items into the angled position. To this end, the partitions can be hinged into the angled position by a hinging movement around a hinge axis. The inserted cutlery items are brought into the angled position by the folded-down cutlery basket partitions.

In accordance with the prior art, the partitions separating the adjustable compartments are usually rigidly connected to a cutlery basket floor. By contrast, for a simple adjustment movement, the inventively adjustable partitions and the cutlery basket floor can be components that are separate from one another. Therein, the hinge axis of the adjustable partition can be arranged in the area of the cutlery basket floor.

To separate the cutlery items, the adjustable partition can have separation bars in-between which the cutlery items can be arranged. The separation bars of the partition can be embodied in the shape of a rake or a comb with free bar ends protruding from the partition. Therein, the free bar ends of the separation bars can protrude freely upwards in the angled position. In this way, access from above to the cleaned cutlery items is simplified once the washing process has finished. In particular, the cutlery items are revealed over their entire length in the angled position so that the cutlery items can be removed by the cutlery handles in a hygienically favorable manner from the cutlery basket.

Cutlery baskets known from the prior art are usually covered by an upper separation grid. The separation grid is, for example, articulated hingeably on the upper side of the cutlery basket. By contrast, the inventive separation bars can be embodied as one material and in one piece with the adjustable partition. Thus, the partition with the protruding separation bars can be embodied as an L shape when viewed from the side.

Usually, a cutlery basket can feature a number of adjustable compartments arranged behind one another as well as alongside one another. Therein, the associated partitions can all be embodied adjustably in the sense of the invention. The partitions can be hinged separately from one another or jointly into the angled position. The associated hinge axes of the partitions can be arranged in parallel to one another in a common horizontal plane, for example.

In accordance with one embodiment, the partition can be adjustable between the loading position and the angled position via at least one guide pin in a slide track. Preferably, the adjustable partitions are positioned between two lateral curtain walls and spaced behind one another. Each of the lateral curtain walls has a least one slide track in which the partitions are guided by lateral guide pins. Depending on the adjustment movement to be carried out, two guide pins can also be provided on each side, of which one makes possible a guided hinge movement of the partition into the angled position, while the other primarily forms the partition hinge axis, which can be guided in a second slide track.

In order to prevent an unintentional adjustment of the partition from the loading position into the angled position, an additional securing element can be provided for securing the partitions in the loading position. The securing element might be a motion stop which, when the upper crockery basket is pulled out, keeps the still empty cutlery basket in its loading position. Only with an additional actuation force on the cutlery basket that can be exerted from the user side can the partitions be adjusted into their angled position. Alternately, a latching arrangement can be used.

The securing element can for example be an undulation embodied in the slide track, such as a stepped ramp or similar. Thus, in the loading position of the guide pins, the partition wall can be secured between a slide track end and the stepped ramp without tipping into the angled position.

BRIEF DESCRIPTION OF THE DRAWINGS

An exemplary embodiment of the invention is described below with reference to the enclosed figures. The figures show.

DETAILED DESCRIPTION OF EXEMPLARY EMBODIMENTS OF THE PRESENT INVENTION

Figure 1:
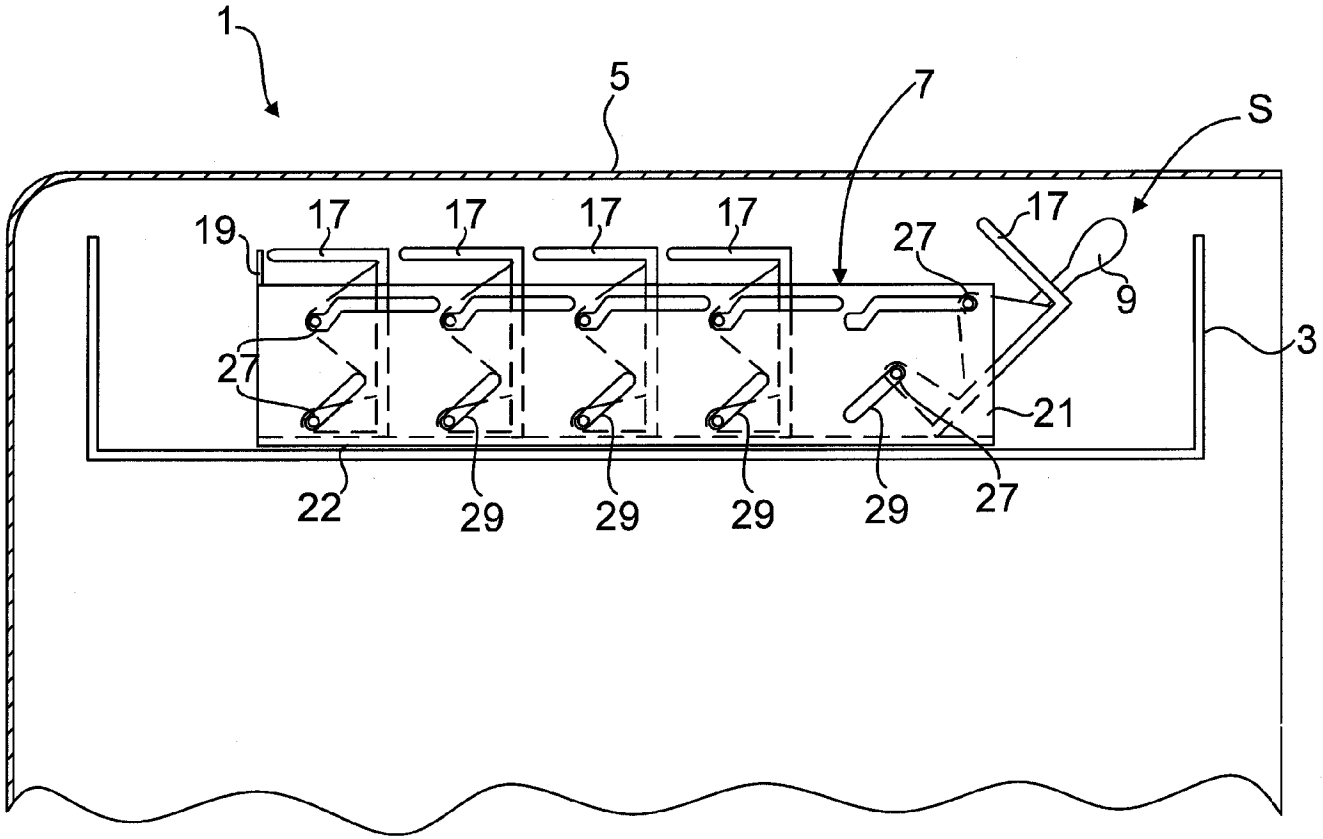
FIG. 1 in a partial side view a washing container of a dishwasher with its upper crockery basket pushed into it.

FIG. 1 shows a part section of an upper area of a washing container 1 of a dishwasher, into which an upper crockery basket 3 is inserted. The stacking space of the upper crockery basket 3 is restricted by a roof panel 5 of the washing compartment 1. In accordance with FIG. 1, a cutlery basket 7 is built into the upper crockery basket 3, which can be arranged for example at a side wall of the crockery basket. The cutlery basket 7 in FIG. 1 is partly loaded with items of cutlery 9 at its end facing towards the washing compartment opening. The cutlery items 9 are arranged in an angled position S in the cutlery basket 3.

Figure 2:
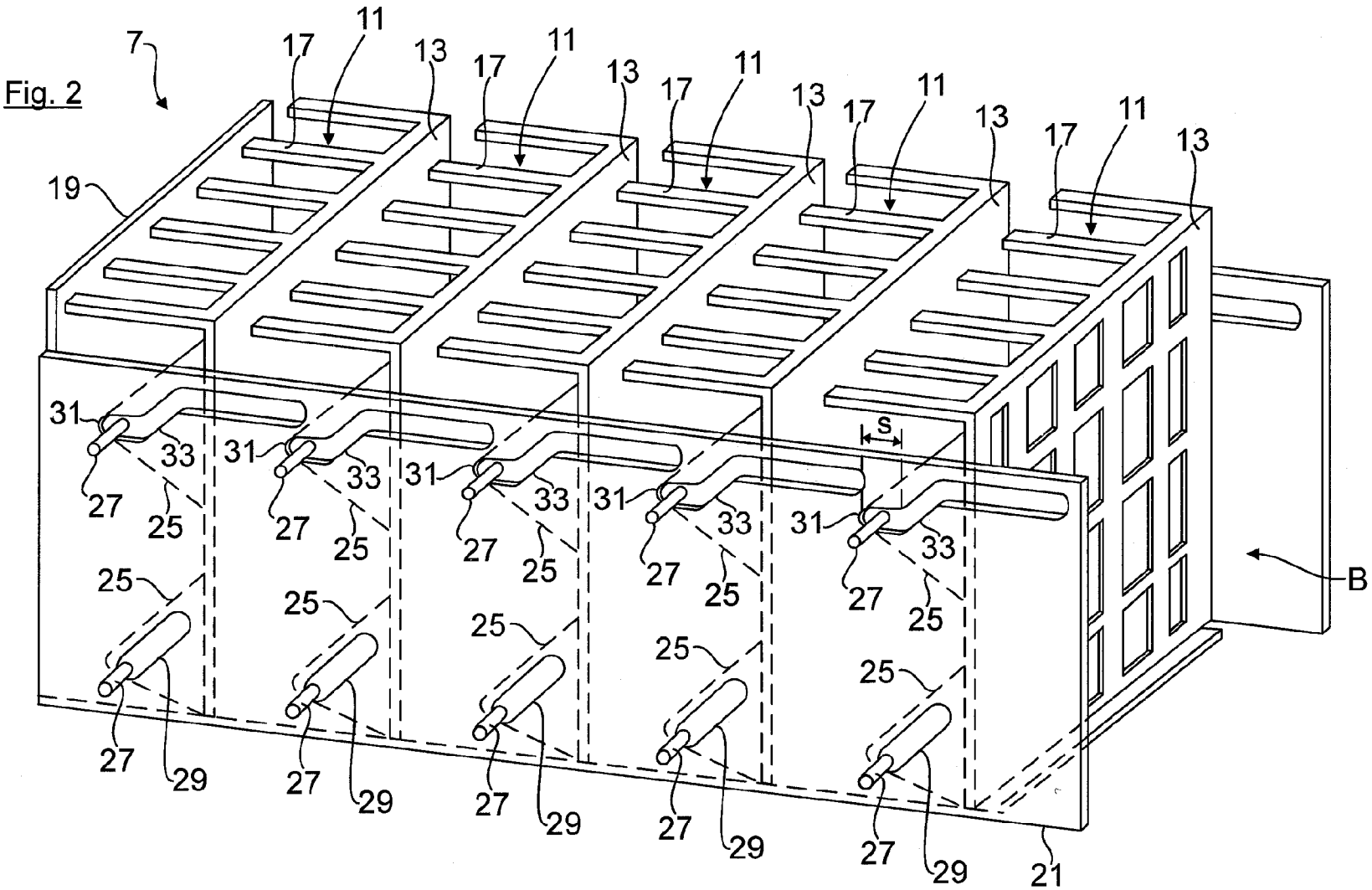
FIG. 2 a perspective view of the crockery basket on its own.

In FIG. 2, the cutlery basket 7 is shown in the unloaded state. Accordingly, the cutlery basket 7 has five adjustable compartments 11 that are arranged in a row behind one another and separated from each other by partitions 13. In FIG. 2, only the right-hand partition 13 is shown as a grid, while the other partitions 13 are shown with enclosed walls for clarity reasons.

The adjustable compartments 11 of the cutlery basket 7 are covered by an upper separation grid 15. The upper separation grid 15 has a total of five rows of separation bars 17 arranged behind one another. The separation bars 17 of each row are formed respectively onto the upper-side edge of the partitions 13 at right angles. Therein, the separation bars 17 are arranged with their free ends protruding from the partitions 13 in the form of a comb, and each faces towards an adjacent partition 13 or a left-hand end face wall 19 shown in FIG. 2 with a small gap.

Each of the adjustable compartments 11 of the cutlery basket 7 is laterally delimited by a side wall 21 and, in the downwards directions, delimited by a cutlery basket floor 23 that is embodied as a floor grid. Therein, the partitions 13 are adjustable in relation to the fixed floor grid 23 as well as the fixed side walls 21. For adjustment purposes, each of the partitions 13 is provided with guide pins 27 via lateral outliers 25, wherein the guide pins 27 are guided in assigned slide tracks 29 of the side walls. Therein, in accordance with FIGS. 2 and 3, the upper guide pins 27 of the partitions 33 are each guided in a Z-shaped slide track 29, while the lower guide pins 27 are guided in sloping linear slide tracks 29.

In FIG. 2, all the partitions 13 are shown in their loading position B, in which they are aligned vertically upwards, in order to facilitate easy loading of cutlery 9 into the adjustable compartments 11 in vertical direction. In the loading position B, the upper guide pins 27 can be freely and slightly moved over a distance s between one end of a slide track 31 and a ramp 33 embodied in the slide track 29, without the partitions 13 falling into their angled position S. Instead, the partitions 13 are held securely in their loading position B.

In FIG. 2, the right-hand partition 13 of the cutlery basket 7 is shown in its angled position S, in which the partition 13 is hinged through an indicated hinge movement I. The upper guide pin 27 rests in the angled position S against the opposite end of the slide track, while the lower guide pin 27 follows this hinge movement I along the lower slide track 29. To execute this hinge movement I in the angled position S, the partition 13 must be slightly lifted by the user in order to overcome the ramp 33 in the upper slide track 29.

The hinge movement I of the partition 13 is undertaken around its lower guide pin 27 through which the hinge axis runs. As already explained, during the hinge movement I, the lower guide pins 27 are lifted along the linear lower slide tracks 29 by which a free space between the angled partition 13 and the adjacent raised partition 13 is increased. In this way, the access area to the items of cutlery 9 lying on the angled partition 13 is advantageously increased.

Figure 3:
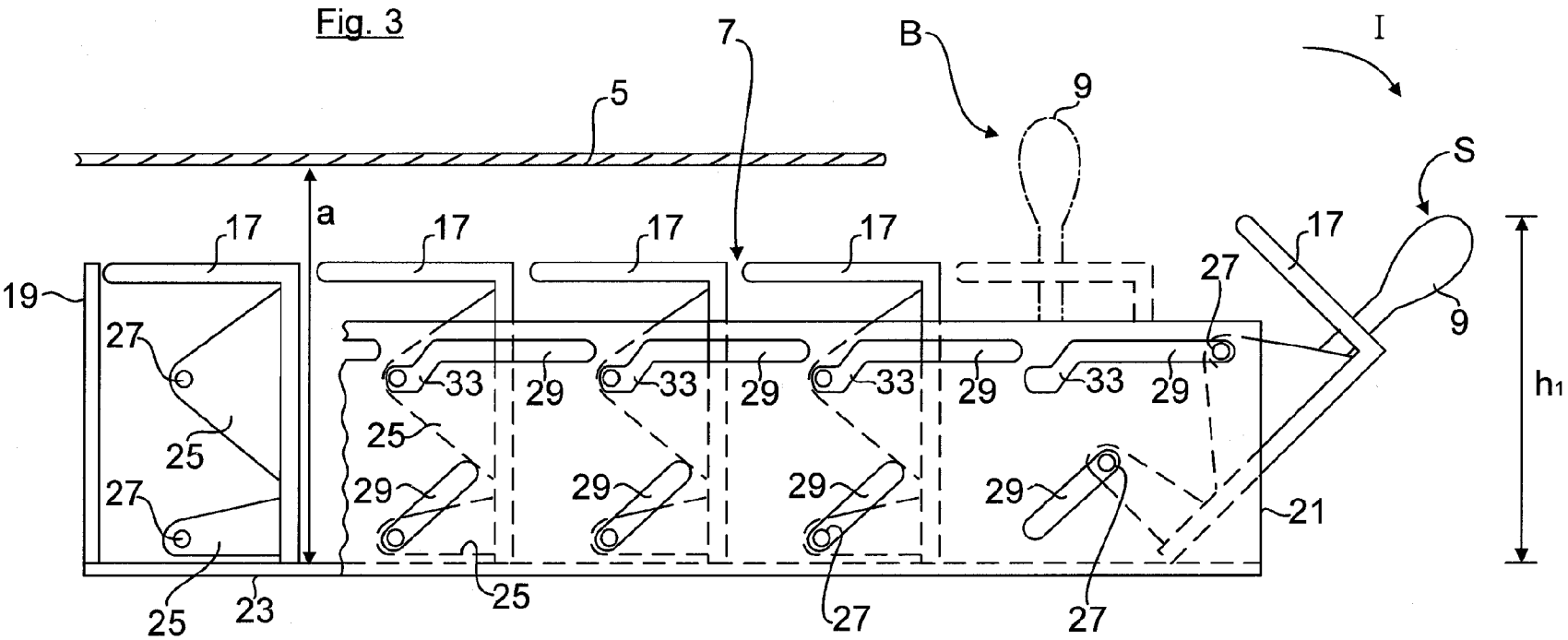
FIG. 3 a side view of the crockery basket.

In FIG. 3, an item of cutlery 9 indicated by a dotted and dashed line is shown in its loading position B in which it rests against a separation bar 17 in a vertically raised manner. In the angled position S, the item of cutlery 9 is supported by the partition 13 and with a reduced clearance height $h_1$. Therein, the clearance height $h_1$ is dimensioned smaller than a distance a between the cutlery basket floor 23 and the washing compartment roof 5, so that the cutlery basket 7 loaded with cutlery 9 is able to be pushed into the washing compartment 1 without hindrance.

Figure 4:
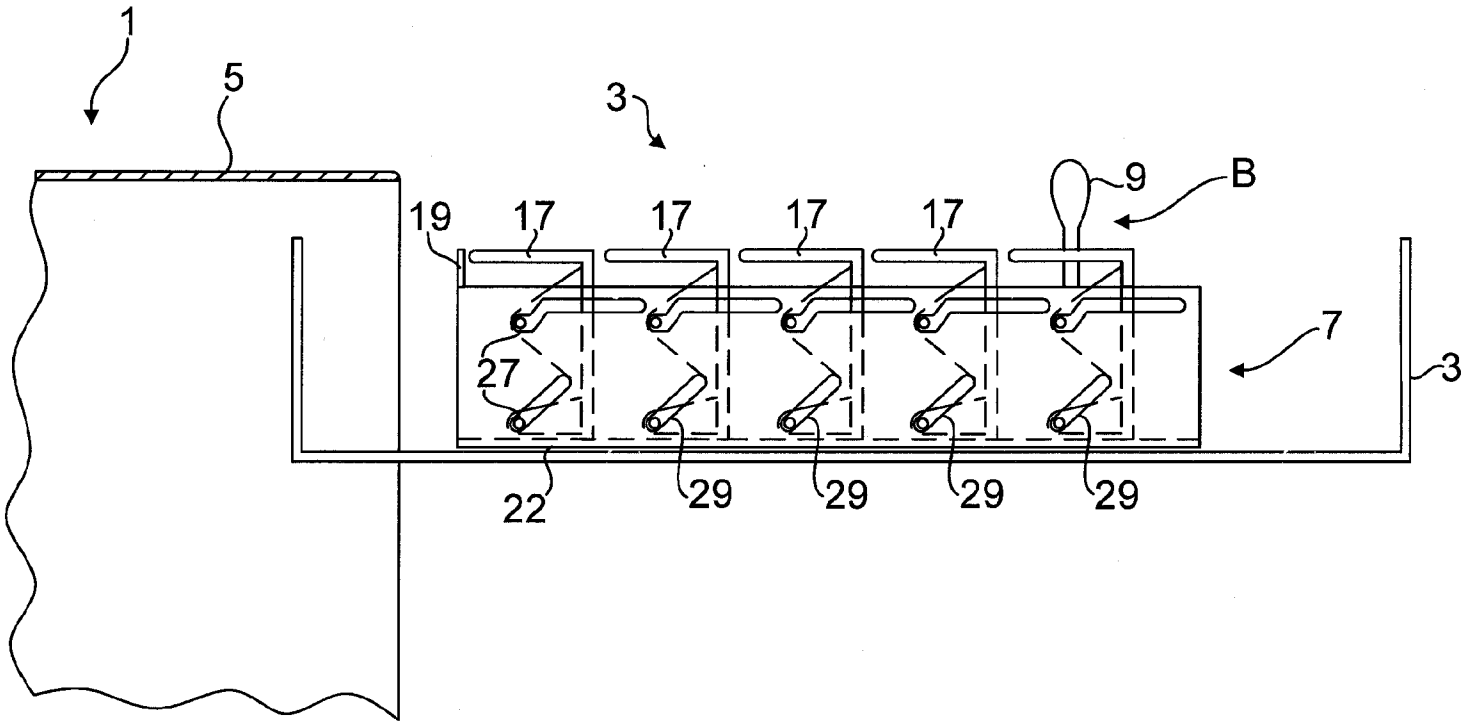
FIG. 4 a view corresponding to that shown in FIG. 1 with the upper crockery basket pushed out of the washing container.

FIG. 4 shows the upper crockery basket 3 pulled out of the washing compartment 1. The partitions 13 of the cutlery basket 7 that is built into the crockery basket 3 are all vertical on the floor of the cutlery basket 23 so that items of cutlery 9 can fall vertically through the separation bar 17 into the cutlery basket 3 when they are loaded. Only after loading has been completed will the partitions adjoining the items of cutlery 9 be moved by the user into the angled position S, as is shown in FIG. 3. In the angled position, the separation bars 17 only project upwards by an angle of the order of magnitude of 40°.

After completion of the washing process, the items of cutlery 9 will generally be revealed over their entire length upwards and between the separation bars 17, which makes it easy to remove them from the cutlery basket 7.

What is claimed:

1. A dishwasher, comprising:

a washing compartment to accommodate items to be cleaned;

a crockery basket insertable into the washing compartment and configured to support items to be cleaned; and a cutlery basket disposed in the crockery basket, the cutlery basket having at least one adjustable compartment for receiving a cutlery item and a cutlery basket floor extending beneath the adjustable compartment, the adjustable compartment being adjustable relative to the cutlery basket floor between a loading position for loading and/or unloading the adjustable compartment and an angled position for carrying out cleaning and/or drying the cutlery item, wherein the adjustable compartment includes at least one support member to support the cutlery item, wherein, in the loading position, the support member is arranged substantially vertically, and, in the angled position, the support member is inclined and thereby configured to cause the cutlery item to be inclined with respect to the crockery basket.

2. The dishwasher of claim 1, wherein the cutlery basket is insertable into the crockery basket, and wherein the dishwasher is a domestic dishwasher.

3. The dishwasher of claim 1, wherein, in the loading position, the adjustable compartment is arranged such that the cutlery item can be inserted vertically into the cutlery basket.

4. The dishwasher of claim 1, wherein the adjustable compartment is moved from the loading position into the angled position and vice versa by a hinge movement.

5. The dishwasher of claim 1, wherein the at least one adjustable compartment is a plurality of adjustable compartments for receiving a plurality of cutlery items.

6. The dishwasher of claim 5, wherein each of the plurality of adjustable compartments is hinged around a respective axis that runs parallel to the other axes.

7. The dishwasher of claim 5, wherein the plurality of adjustable compartments is hinged around one axis.

8. The dishwasher of claim 1, wherein the cutlery basket has an adjustment device to move the cutlery item from the loading position into the angled position.

9. The dishwasher of claim 8, wherein the support member comprises at least a partition of the cutlery basket, and the adjustment device includes the partition which partly delimits the adjustable compartment of the cutlery basket.

10. The dishwasher of claim 9, wherein the partition of the cutlery basket is hinged in a hinging movement around a hinge axis from the loading position into the angled position.

11. The dishwasher of claim 10, wherein the partition is movable relative to the cutlery basket floor, and the hinge axis of the partition is arranged on a floor side in the cutlery basket.

12. The dishwasher of claim 9, wherein the adjustment device has separating bars that are arranged as a comb with free bar ends protruding from the partition.

13. The dishwasher of claim 12, wherein, in the angled position, the free bar ends of the separation bars protrude upwards.

14. The dishwasher of claim 12, wherein the separation bars of the adjustment device form an upper separation grid of the cutlery basket.

15. The dishwasher of claim 9, wherein a plurality of partitions of the cutlery basket is arranged in a row, and wherein respective ones of the plurality of partitions are adjusted one of separately from each other and jointly into the angled position.

16. The dishwasher of claim 9, further comprising a guide pin and a slide track, wherein the partition is adjustable, via the guide pin, in the slide track between the loading position and the angled position.

17. The dishwasher of claim 16, wherein the slide track is formed in a side wall laterally delimiting the partition.

18. The dishwasher of claim 16, further comprising a securing element, wherein the adjustment device is held in the loading position by means of the securing element to prevent an unintentional movement of the cutlery item from the loading position into the angled position.

19. The dishwasher as claimed in claim 18, wherein the securing element is a movement stop that is overcome by a force that a user exerts on the cutlery basket.

20. The dishwasher as claimed in claim 18, wherein the securing element is a slope formed in the slide track that prevents a movement of the guide pin into the angled position.

21. The dishwasher of claim 1, further comprising an upper crockery basket, wherein the cutlery basket is arranged in the upper crockery basket.

* * * * *